US007789978B2

(12) United States Patent
Ward

(10) Patent No.: US 7,789,978 B2
(45) Date of Patent: Sep. 7, 2010

(54) ALLOY FOR LITHOGRAPHIC SHEET

(75) Inventor: John Andrew Ward, Leamington Spa (GB)

(73) Assignee: Novelis Inc., Toronto (CA)

( * ) Notice: Subject to any disclaimer, the term of this patent is extended or adjusted under 35 U.S.C. 154(b) by 1071 days.

(21) Appl. No.: 10/488,848

(22) PCT Filed: Sep. 11, 2002

(86) PCT No.: PCT/GB02/04129

§ 371 (c)(1),
(2), (4) Date: Aug. 17, 2004

(87) PCT Pub. No.: WO03/023079

PCT Pub. Date: Mar. 20, 2003

(65) Prior Publication Data

US 2005/0023150 A1 Feb. 3, 2005

(30) Foreign Application Priority Data

Sep. 12, 2001 (GB) ..... 0121927.8

(51) Int. Cl.
*C22C 21/10* (2006.01)

(52) U.S. Cl. ..... 148/437; 420/531; 420/540

(58) Field of Classification Search ..... None
See application file for complete search history.

(56) References Cited

U.S. PATENT DOCUMENTS 4,822,715 A * 4/1989 Shoji et al. ..... 430/155
6,555,247 B2 * 4/2003 Yamaguchi ..... 428/610

FOREIGN PATENT DOCUMENTS

| | | | |
|---|---|---|---|
| EP | 0096347 | | 12/1983 |
| EP | 0853132 | | 7/1998 |
| EP | 0887430 | | 12/1998 |
| JP | 08311592 A | * | 11/1996 |
| JP | 09316582 A | * | 12/1997 |

OTHER PUBLICATIONS

English translation of JP 08-311592A.*
English translation of JP 09-316582A.*
English language Abstract of Japan Patent Publication No. 09316582, Patent Abstracts of Japan, published Dec. 9, 1997.
English language Abstract of Japan Patent Publication No. 08311592, Patent Abstracts of Japan, published Nov. 26, 1996.
English language Abstract of Japan Patent Publication No. 08292593, Patent Abstracts of Japan, published Nov. 5, 1996.
Hufnagel, W., Aluminum-Taschenbuch, Aluminium Verlag, Düsseldorf, Germany, p. 1011, 1983.

* cited by examiner

*Primary Examiner*—George Wyszomierski
(74) *Attorney, Agent, or Firm*—Cooper & Dunham LLP

(57) ABSTRACT

There is disclosed an Al alloy suitable for processing into a lithographic sheet, the alloy having a composition in wt %: Fe up to 0.4; Si up to 0.25; Ti up to 0.05; Cu up to 0.05; Zr up to 0.005; Cr up to 0.03; Ni up to 0.006; V up to 0.03; Zn up to 0.008 to 0.15; Mg up to 0.30; Mn up to 1.5. Unavoidable impurities up to 0.05 wt % total Al balance. The alloy allows production of the required surface for lithographic sheet over a wide range of process conditions.

16 Claims, 3 Drawing Sheets

ALLOY FOR LITHOGRAPHIC SHEET

This invention relates to an Al alloy suitable for processing into a lithographic sheet, particularly one which exhibits an acceptable grained surface over a broad range of processing conditions, and also includes a method of processing the alloy.

At present the lithographic sheet market largely consists of products in the AA1XXX and AA3XXX alloy range. The surface morphology of nitric acid electrograined plates can be greatly determined by a number of factors, for example the current density and line speed of the process or the chemical composition of the alloy used. It is generally accepted that, to produce the required pitted structure with no variability along and across the coil, the current density and line speed need to be tightly controlled as well as the chemical composition of the alloy. This makes electrograining in nitric acid based electrolyte a very critical process where parameters have to be tightly controlled. It is also important for the electrograined surface not to appear metallic which can arise when the formation of larger pits is favoured, leaving areas of the aluminium surface unattacked (ungrained plateau areas). A more even distribution of pits is desirable giving the required matt looking surface. For these reasons, commercial pure lithographic sheets for nitric acid processes are normally AA1050A, 99.5% pure aluminium. Furthermore, a relatively narrow range of process conditions is necessary to produce satisfactory electrograining for lithographic sheet with the use of AA1050A alloys.

According to the present invention, there is provided an Al alloy suitable for processing into a lithographic sheet, the alloy having a composition in wt %:

Fe up to 0.4
Si up to 0.25
Ti up to 0.05
Cu up to 0.05
Zr up to 0.005
Cr up to 0.03
Ni up to 0.006
V up to 0.03
Zn 0.008 to 0.15
Mg up to 0.30
Mn up to 1.5
Unavoidable impurities up to 0.05 wt % each, 0.15 wt % total Al balance.

It has been found that the alloy composition of the invention allows production of the required surface for lithographic sheet over a wider range of process conditions, in particular current density and line speed, than is currently available with AA1050A with no addition of zinc. This may allow a faster electrograining process, thereby having the potential to increase productivity. In addition, lithographic customers will usually have some variability in their operating parameters and hence the supply of the alloy of the invention should satisfy all of these. In this respect, in preferred embodiments, the addition of zinc gives a product with a wider graining window which is more suitable for a range of customers using nitric acid electrograining processes.

The alloying elements iron, silicon and titanium are tightly controlled in lithographic grade AA1050A but levels of impurities such as copper, manganese, magnesium, chromium, nickel, gallium, zinc and vanadium can vary depending on smelter source. Each impurity element can affect the electrograining response of the alloy in a different way depending on concentration, hence affecting the surface morphology. The effects of even low levels of certain elements (0.001 to 0.03 wt %) can result in large pits being formed resulting in a more metallic-looking lithographic printing plate, which may be rejected for printing purposes. Addition of zinc in accordance with the invention reduces the effects of these elements producing a more finely pitted structure on electrograining when such elements are present at significant levels.

Control of the alloying elements is important as low silicon and high titanium levels within the specification can cause poor and variable graining due to the lack of pit initiation. Addition of zinc (for example to a level of 0.02 wt %) to such an alloy reduces this effect giving the required surface morphology on graining.

Zinc is preferably present in an amount of 0.01 to 0.15 wt %, even more preferably 0.013 to 0.05 wt %. As mentioned above, zinc has been particularly found to allow improved graining, for example electrograining in nitric acid.

Whilst vanadium may or may not be deliberately added, when it is present the invention may provide further advantages. In this respect, under normal circumstances, when AA1050A alloys contain vanadium, poor graining is experienced particularly when the vanadium is present in amounts above 0.013 wt %. The addition of zinc serves to reduce this detrimental effect. In a preferred embodiment, the Zn/V ratio is at least about 0.6, preferably at least about 0.8, even more preferably at least about 1. Further advantages may be seen when the Zn/V ratio is at least about 2 at higher current density and/or faster line speeds.

Iron is preferably present in an amount of 0.25 to 0.4 wt % and, independently, silicon is preferably present in an amount of 0.07 to 0.20 wt %.

Preferably copper is present in an amount up to 0.01 wt %, even more preferably up to 0.004 wt %.

Chromium is present, in a preferred embodiment, in an amount up to 0.004 wt %.

If present, magnesium may be present in a preferred amount of 0.05 to 0.3 wt %, preferably 0.06 to 0.30 wt %, and more preferably 0.10 to 0.30 wt %. If present, manganese may preferably be present in an amount of up to 0.25 wt %, preferably 0.05 to 0.25 wt %, even more preferably 0.05 to 0.20 wt %.

According to a second aspect of the present invention, there is provided a lithographic sheet formed from the alloy.

According to a further aspect of the present invention, there is provided the use of the alloy in the formation of a lithographic sheet.

According to a further aspect of the present invention there is provided a method of processing an Al alloy as defined above, which method comprises the steps of forming the alloy into a sheet and graining a surface thereof. The alloy may be formed into a sheet by steps which may include casting, scalping, homogenising, hot rolling, cold rolling, optional interannealing, cleaning and levelling.

Heat treatment after casting may be carried out in a single heat-to-roll step or as a two step process where ingots or the like are held at a higher temperature than the rolling temperature to homogenise the iron in solution more quickly and then cooling to the rolling temperature. An example of the former would be to heat the scalped ingot to 450-550° C. by ramped heating and holding at that temperature for 1 to 16 hours. An example of the latter is to heat to 550-610° C. and hold for 1-10 hours followed by cooling and rolling at 450-550° C.

Where an intermediate annealing step is present, it may be carried out immediately after hot rolling or during cold rolling. The interannealing may be carried out as a batch interannealing, in which case it is preferably carried out at 300 to 500° C., for example for 1 to 5 hours. Alternatively, the interannealing may be continuous, in which case it is preferably carried out at 450 to 600° C. for example for up to 5 minutes, even more preferably up to 1 minute.

The resulting strip is usually flattened and cleaned.

The graining is preferably electrograining, which may be carried out in nitric acid or hydrochloric acid, more preferably nitric acid. Prior to graining the surface is typically given an alkaline clean to refresh the surface. Under previously determined optimum graining conditions, electrograining is typically carried out in a 1% nitric acid solution at 35-50° C. and with a typical current density of 8 $kAm^{-2}$. The actual line speeds and voltages employed are strongly dependent on the cell geometry, but the current density reflects the reaction rate that can be sustained, consistent with obtaining a satisfactory surface, and is thus a good indicator of the efficiency of the process. Alternatively, under previously determined optimum graining conditions, the time of treatment is about 7.2 seconds and the present invention enables, for example, an increase in the current density of about 20% whilst maintaining the correct surface finish and reducing the treatment time to about 6 seconds.

Therefore, using the current invention the current density and/or line speed during graining may be increased relative to the previously determined optimum graining conditions yet still provide a lithographic sheet with an acceptable resulting surface. This is the wider processing window alluded to above. A preferred increase in these parameters is between 10 and 30% in current density and therefore line speed, more preferably about 20% relative to previously determined optimum graining conditions. The present invention is thus able to provide the desired surface roughness for lithographic sheet after graining for a reduced time relative to an alloy in which zinc is absent.

Therefore, according to a further aspect of the present invention, there is provided a method of processing an Al alloy having a composition in wt %:

Fe up to 0.4
Si up to 0.25
Ti up to 0.05
Cu up to 0.05
Zr up to 0.005
Cr up to 0.03
Ni up to 0.006
V up to 0.03
Zn 0.008 to 0.15
Mg up to 0.30
Mn up to 1.5
Unavoidable impurities up to 0.05 wt % each, 0.15 wt % total Al balance, wherein the Zn/V ratio is at least about 0.6, and wherein the method comprises the steps of forming the alloy into a sheet and graining a surface thereof, wherein the desired surface roughness after graining is achievable in a reduced graining time relative to an alloy in which zinc is absent.

According to a further aspect of the present invention, there is also provided a method of forming a lithographic sheet.

The invention will now be described, by way of example, with reference to the following drawings and example, and in which.

EXAMPLE

TABLE 1

| | Chemical composition of Alloys | | | | | | | | | | |
|---|---|---|---|---|---|---|---|---|---|---|---|
| ID | % Si | % Fe | % Cu | % Mn | % Mg | % Cr | % Ni | % Zn | % Ti | % Ga | % V |
| 1 | 0.09 | 0.29 | 0.002 | 0.002 | 0.004 | 0.002 | 0.002 | 0.003 | 0.005 | 0.010 | 0.005 |
| 2 | 0.09 | 0.28 | 0.002 | 0.002 | 0.001 | 0.001 | 0.005 | 0.002 | 0.005 | 0.014 | 0.014 |
| 3 | 0.10 | 0.28 | 0.002 | 0.002 | 0.001 | 0.001 | 0.001 | 0.017 | 0.005 | 0.010 | 0.006 |
| 4 | 0.09 | 0.29 | 0.002 | 0.002 | 0.002 | 0.001 | 0.001 | 0.013 | 0.005 | 0.010 | 0.014 |
| 5 | 0.09 | 0.30 | 0.003 | 0.002 | 0.001 | 0.000 | 0.001 | 0.008 | 0.005 | 0.010 | 0.014 |

Figure 1:
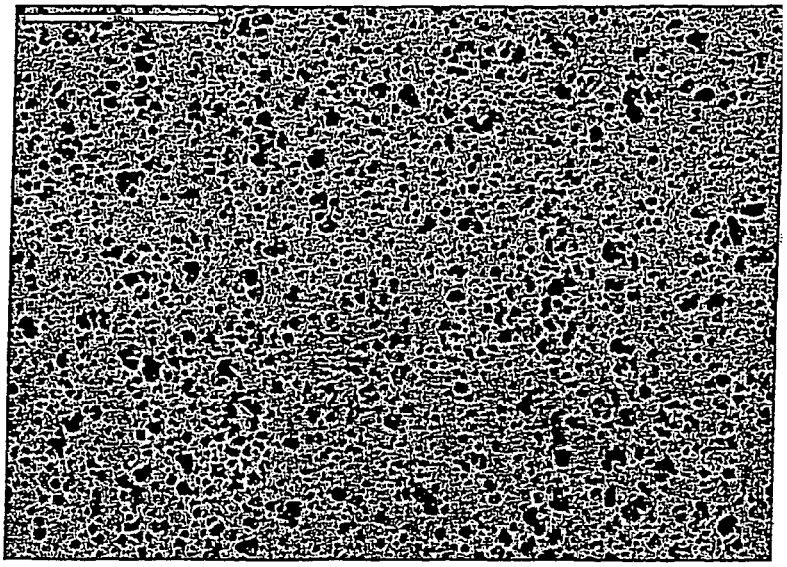
FIG. 1 shows a scanning electron microscopy (SEM) view of a typical AA1050A alloy electrograined under normal conditions in a nitric acid electrolyte.
Figure 2:
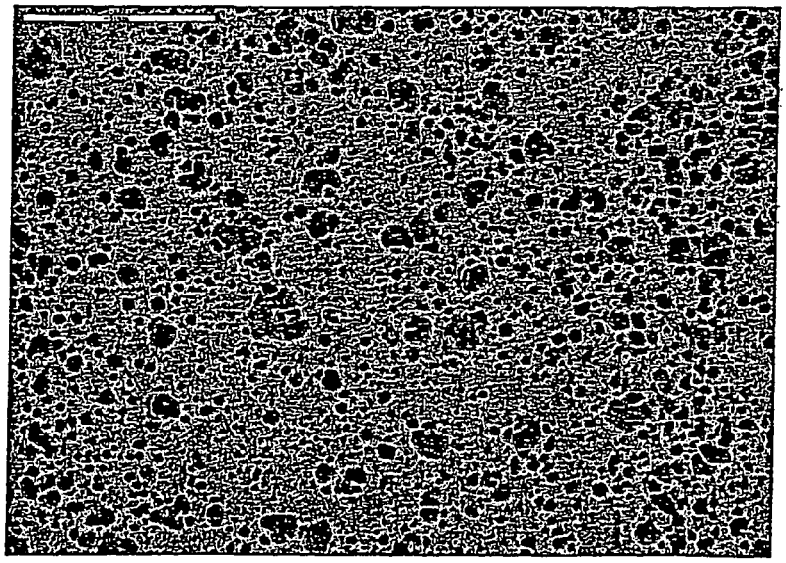
FIG. 2 shows a SEM view where the alloy has been electrograined with a 20% increase in line speed and current in a nitric acid electrolyte.

Electrograining was carried out in a 1% solution of nitric acid at 40° C. A pilot cell arrangement was employed that used the liquid contact method, had graphite counter electrodes of 480 mm length and a cell separation of about 25 mm. The standard graining conditions were 8 $kAm^{-2}$ and a line speed of about 8 m/min. A typical AA1050A, 9963 alloy variant used for graining in nitric acid electrolytes is given in Table 1 (alloy 1). Electrograining trials with this type of alloy, under normal electrograining current and line speed, gives a visually good surface with no variability or metallic appearance. Scanning electron microscopy studies show an evenly pitted surface with an average roughness Ra of between 0.9 and 1.1 microns using a perthen LS1 or Focodyn laser probe (FIG. 1). Increasing the current up to 20% higher than normal has the effect of producing undesirably larger pits on the surface. In this case the surface is considered overgrained because of the increased current and charge density. If the material is then grained at a 20% increase in line speed and increase in 20% current density then the surface has been grained with equivalent charge to the normal conditions. However, the surface contained large pits which may not be acceptable on the lithographic plate (FIG. 2). Therefore, there is a need under existing practice for controlled electrograining conditions to produce the required surface morphology on the printing plate.

Figure 3:
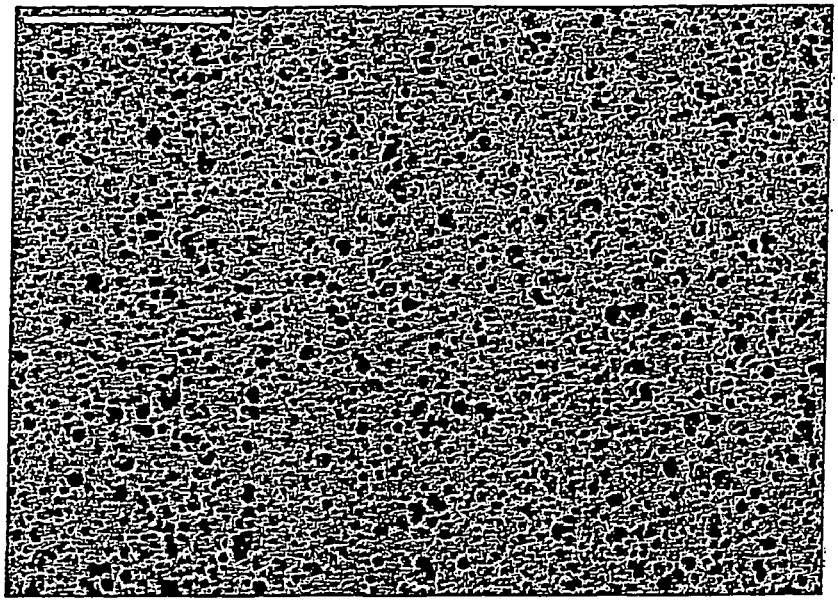
FIG. 3 shows a SEM view where the alloy has 0.017 wt % added zinc and has been electrograined under normal conditions in a nitric acid electrolyte.
Figure 4:
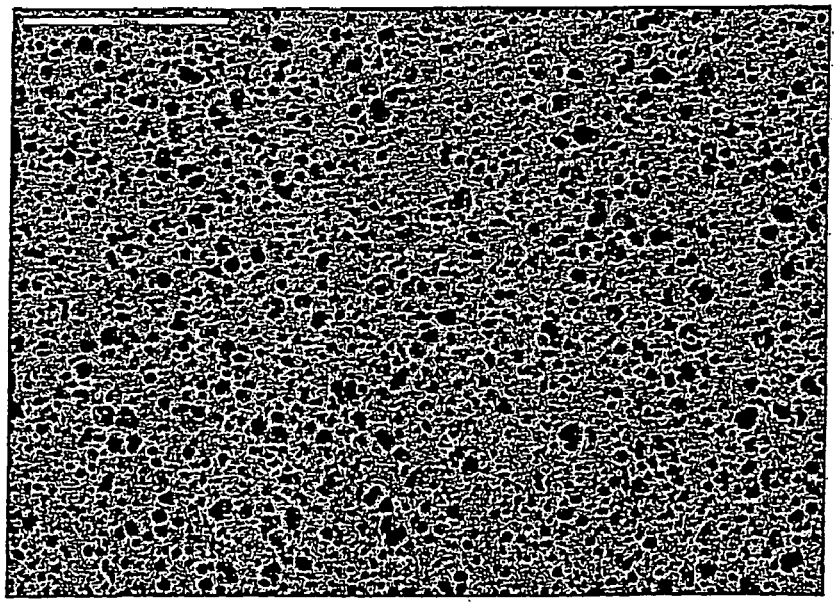
FIG. 4 shows a SEM view where the alloy has 0.017 wt % added zinc and has been electrograined with a 20% increase in line speed and current in a nitric acid electrolyte.

If an alloy similar to alloy 1 is used with an addition of 0.017% Zn (alloy 3) a good surface is produced under normal electrograining conditions similar to that mentioned above, as shown in FIG. 3. Electrograining this same alloy with up to 20% higher current and 20% faster line speed also gave a satisfactory surface with fine pits similar to that seen under normal conditions, as shown in FIG. 4. This is somewhat different and an improvement over the alloy with no zinc addition as it enabled graining at a higher current and line speed, thereby enabling faster graining to be achieved. Similar observations have been seen with zinc at 0.024%.

Figure 5:
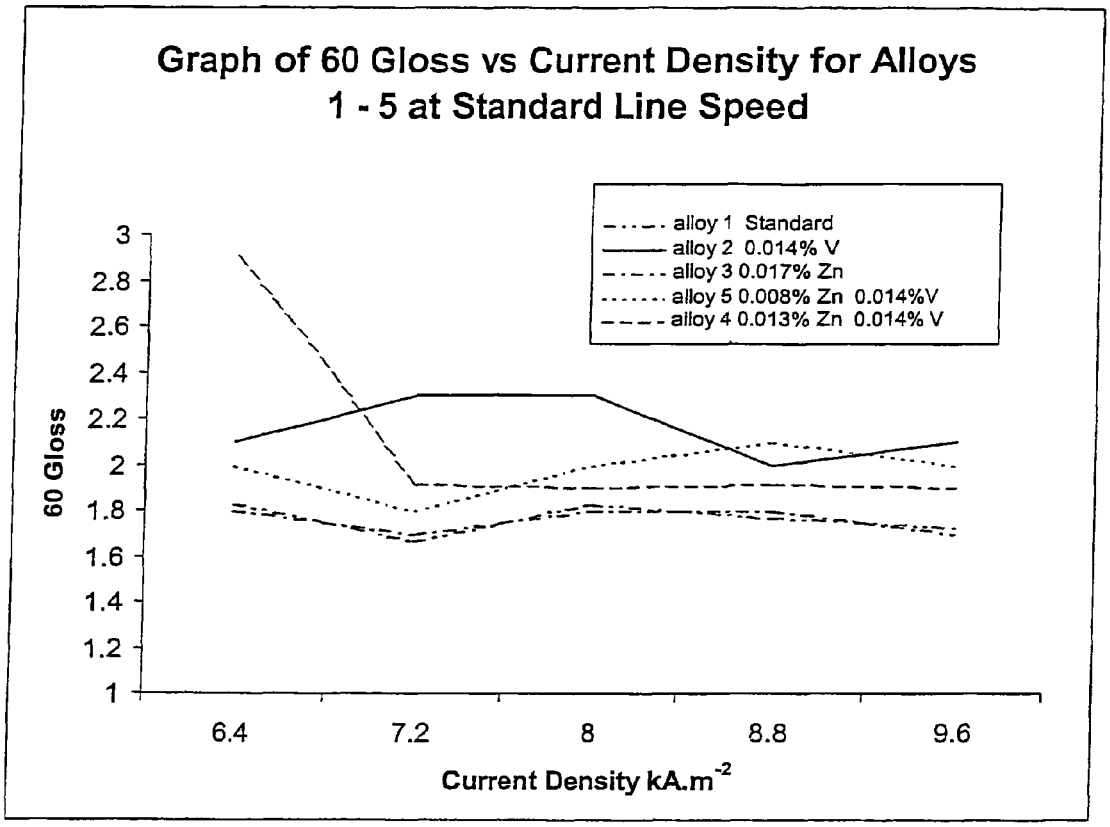
FIG. 5 is a graph of gloss against current density for a series of alloys.

It has been found that poor graining can be experienced when AA1050A contains levels of vanadium above about 0.013%. In such circumstances, graining in nitric acid promotes the formation of large pits and less grained plateaux regions making the surface of more metallic appearance. Therefore, on the final electrograined surface pit clusters can be favoured as opposed to the more even distribution shown in FIG. 1. This can be illustrated by gloss values on the electrograined surface, as shown in FIG. 5. It has been found that less matt surfaces are obtained over a wide range of graining conditions with the alloy containing 0.014 wt % vanadium, alloy 2. Measured gloss with the zinc addition only (alloy 3) is comparable to that found with alloy 1. It can be seen that the gloss can be reduced to some degree by the addition of zinc to an alloy containing vanadium. This is illustrated with additions of 0.008 wt % (alloy 5) and 0.013 wt % (alloy 4) zinc.

The following conclusions can be drawn:

Vanadium at 0.014 wt % results in less matt surfaces when graining in nitric acid with pit clusters formed under certain conditions.

Zinc at 0.017 wt % gave good graining properties in nitric acid. Similar surfaces to the standard alloy were seen but with slightly finer pits. Finer pitted surfaces than the standard alloy were seen with higher line speed where large pits associated with higher current were less visible.

Zinc at 0.017 wt % would be acceptable and possibly advantageous in commercial lithographic sheet providing iron, silicon, titanium and other minor elements are at the required levels.

The electrograining characteristics of alloys with vanadium at 0.014 wt % in combination with zinc at two levels (0.008 wt % and 0.013 wt %) has been investigated. The alloy containing 0.008 wt % zinc and 0.014 wt % vanadium gave a finer pit structure but with some pit clustering and was less matt than the standard alloy. The alloy containing 0.013 wt % zinc and 0.014 wt %, vanadium (alloy 4) also gave more maft surfaces than alloy 5. Hence a further increase of the zinc level to 0.013% does appear to have improved the graining still further.

Further work with higher zinc and vanadium variants shows some evidence of pit clustering but the addition of vanadium to high zinc only variants reduced the effectiveness of the alloy to grain at higher line speeds. However adequate graining was seen, as shown in Table 2.

TABLE 2

| | | % Zinc | | | | |
|---|---|---|---|---|---|---|
| | | 0.003 | 0.008 | 0.013 | 0.017 | 0.024 |
| % Vanadium | 0.005 | ○ | | | ○○ | ○○ |
| | 0.014 | Δ | Δ/○ | ○ | | |
| | 0.018 | | | | ○ | ○ |
| | 0.025 | X | | | | ○ |

○○ good graining window - improvements at normal and faster line speeds allowing 6.4-9.6 $KAm^{-2}$ ○ adequate graining for normal graining conditions 6.4-8 $KAm^{-2}$ Δ inadequate graining morphology X poor graining It can be seen that satisfactory results are obtained where the Zn/V ratio is about 1.

In conclusion, alloy chemistry can affect the surface produced after electrograining. The presence of certain elements at relatively low levels can cause the surface to appear variably metallic after electrograining. One such element is vanadium. It can be seen that addition of zinc to the alloy reduces the effects of such elements reducing the risk of the alloy being rejected for bad graining.

The invention claimed is:

1. An Al alloy suitable for processing into a lithographic sheet, the alloy having a composition in wt %:

Fe up to 0.4
Si up to 0.25
Ti up to 0.05
Cu up to 0.05
Zr up to 0.005
Cr up to 0.03
Ni up to 0.006
V 0.005 to 0.03
Zn 0.008 to 0.15
Mg up to 0.30
Mn up to 1.5
Unavoidable impurities up to 0.05 wt % each, 0.15 wt % total Al balance, and wherein the Zn/V ratio is at least about 0.6.

2. An alloy according to claim 1, wherein Zn is present in an amount of 0.01 to 0.15 wt %.

3. An alloy according to claim 1, wherein Zn is present in an amount of 0.013 to 0.05 wt %.

4. An alloy according to claim 1, wherein V is present in an amount of 0.013 to 0.03 wt %.

5. An alloy according to claim 1, wherein the Zn/V ratio is at least about 1.

6. An alloy according to claim 1, wherein the Zn/V ratio is at least about 2.

7. An alloy according to claim 1, wherein Fe is present in an amount of 0.25-0.4 wt %.

8. An alloy according to claim 1, wherein Si is present in an amount of 0.07-0.20 wt %.

9. An alloy according to claim 1, wherein Cu is present in an amount up to 0.01 wt %, preferably 0.004 wt %.

10. An alloy according to claim 1, wherein Cr is present in an amount up to 0.004 wt %.

11. An alloy according to claim 1, wherein Ti is present in an amount of up to 0.03 wt %.

12. An alloy according to claim 1, wherein Mg is present in an amount of 0.05 to 0.30 wt %.

13. An alloy according to claim 1, wherein Mn is present in an amount of up to 0.25 wt %.

14. An alloy according to claim 1, wherein Mn is present in an amount of 0.05 to 0.25 wt %.

15. A lithographic sheet formed from the alloy of claim 1.

16. The method of using an alloy of claim 1 comprising forming a lithographic sheet from said alloy.

* * * * *